US010370837B2

(12) United States Patent
Wood et al.

(10) Patent No.: US 10,370,837 B2
(45) Date of Patent: Aug. 6, 2019

(54) SELF-CONTAINED TOILET BOWL DISPENSER AND LIGHT

(71) Applicant: HOMEMATION LLC, Layton, UT (US)

(72) Inventors: Taylor Brett Wood, Provo, UT (US); Daken Marcus Tanner, Provo, UT (US); Jeremy Todd Stevenson, Orem, UT (US); Jacob Lynn Larsen, Kaysville, UT (US)

(73) Assignee: Homemation LLC, Layton, UT (US)

( * ) Notice: Subject to any disclaimer, the term of this patent is extended or adjusted under 35 U.S.C. 154(b) by 0 days.

(21) Appl. No.: 15/596,388

(22) Filed: May 16, 2017

(65) Prior Publication Data

US 2018/0334788 A1 Nov. 22, 2018

(51) Int. Cl.
*E03D 9/00* (2006.01)
*A47K 17/00* (2006.01)

(52) U.S. Cl.
CPC ..... *E03D 9/005* (2013.01); *A47K 17/00* (2013.01)

(58) Field of Classification Search
CPC ..... E03D 9/005; E03D 9/002; A47K 17/00
USPC ..... 4/223
See application file for complete search history.

(56) References Cited

U.S. PATENT DOCUMENTS

| | | | | |
|---|---|---|---|---|
| 3,178,070 | A | 4/1965 | Leland | |
| 4,327,451 | A | 5/1982 | Baus | |
| 4,630,322 | A | 12/1986 | Kuo | |
| 5,031,252 | A | 7/1991 | Oyama | |
| 5,136,476 | A * | 8/1992 | Horn | A47K 17/00 4/661 |
| 5,377,363 | A | 1/1995 | Shieh | |
| 6,098,211 | A | 8/2000 | Ehrensperger et al. | |
| 6,457,435 | B1 | 10/2002 | Bridges | |
| 7,603,726 | B2 | 10/2009 | Sawalski | |
| 8,261,377 | B2 | 9/2012 | Oh | |
| 8,359,676 | B2 | 1/2013 | Richard et al. | |
| 8,603,257 | B2 | 12/2013 | Burt et al. | |
| 8,966,676 | B2 | 3/2015 | Hamakita et al. | |
| 9,375,745 | B2 | 6/2016 | Finch | |
| 2004/0199985 | A1 | 10/2004 | Wilson et al. | |
| 2005/0028254 | A1 | 2/2005 | Whiting | |

(Continued)

FOREIGN PATENT DOCUMENTS

| | | |
|---|---|---|
| CN | 2307844 Y | 2/1999 |
| CN | 2713029 Y | 7/2005 |

(Continued)

OTHER PUBLICATIONS

International Search Report and Written Opinion dated Jul. 23, 2018 from International Patent Application No. PCT/US2018/017289 filed Feb. 7, 2018.

(Continued)

*Primary Examiner* — Tuan N Nguyen
(74) *Attorney, Agent, or Firm* — Workman Nydegger

(57) ABSTRACT

A toilet dispenser and light is disclosed. Upon detection and activation from sensors, a light may be used to illuminate a toilet bowl, and a treatment substance may be dispensed into the toilet bowl. The dispenser correspondingly configures to hang from the rim of a toilet bowl. Portions of the dispenser may be replaceable, such as a power source and a propellant container used to house a treatment substance.

14 Claims, 14 Drawing Sheets

(56) References Cited

U.S. PATENT DOCUMENTS

| | | | |
|---|---|---|---|
| 2007/0256226 | A1 | 11/2007 | Pinizzotto |
| 2009/0249533 | A1 | 10/2009 | Sawalski et al. |
| 2010/0031982 | A1 | 2/2010 | Hornsby et al. |
| 2010/0205728 | A1 | 8/2010 | Muhlhausen et al. |
| 2010/0205731 | A1* | 8/2010 | Muhlhausen ..... E03D 9/005 4/223 |
| 2010/0243776 | A1 | 9/2010 | Forster |
| 2011/0088153 | A1 | 4/2011 | Richard et al. |
| 2012/0266920 | A1 | 10/2012 | Burt et al. |
| 2013/0025038 | A1 | 1/2013 | Frey et al. |
| 2017/0251893 | A1 | 9/2017 | Wink et al. |

FOREIGN PATENT DOCUMENTS

| | | | |
|---|---|---|---|
| CN | 2761716 | Y | 3/2006 |
| CN | 2761717 | Y | 3/2006 |
| CN | 2765955 | Y | 3/2006 |
| CN | 2765956 | Y | 3/2006 |
| CN | 2765957 | Y | 3/2006 |
| CN | 2775158 | Y | 4/2006 |
| CN | 2782797 | Y | 5/2006 |
| CN | 2784483 | Y | 5/2006 |
| CN | 2786212 | Y | 6/2006 |
| CN | 2796628 | Y | 7/2006 |
| CN | 2910086 | Y | 6/2007 |
| CN | 201087471 | Y | 7/2008 |
| CN | 1755055 | B | 10/2010 |
| CN | 202017245 | U | 10/2011 |
| CN | 101736794 | B | 11/2011 |
| CN | 202139666 | U | 2/2012 |
| CN | 204155099 | U | 2/2015 |
| CN | 104644045 | A | 5/2015 |
| CN | 204995346 | U | 1/2016 |
| CN | 105649159 | A | 6/2016 |
| CN | 106368279 | A | 2/2017 |
| CN | 206467740 | U | 2/2017 |
| CN | 106522329 | B | 3/2017 |
| CN | 206294707 | U | 7/2017 |
| CN | 206477413 | U | 9/2017 |
| CN | 206554209 | U | 10/2017 |
| CN | 206571202 | U | 10/2017 |
| EP | 2657415 | A1 | 10/2013 |
| FR | 2907813 | A1 | 5/2008 |
| JP | 2000096676 | A | 4/2000 |
| JP | 2001227026 | A | 8/2001 |
| JP | 2005344300 | A | 12/2005 |
| JP | 2007209642 | A | 8/2007 |
| JP | 2008174957 | A | 7/2008 |
| JP | 2012082615 | A | 4/2012 |
| JP | 2012149512 | A | 8/2012 |
| JP | 2012202102 | A | 10/2012 |
| JP | 2013079578 | A | 5/2013 |
| JP | 2013155595 | A | 8/2013 |
| JP | 2014163162 | A | 9/2014 |
| JP | 2016037702 | A | 3/2016 |
| JP | 2016044400 | A | 4/2016 |
| JP | 2016094712 | A | 5/2016 |
| JP | 2017160653 | A | 9/2017 |
| KR | 101729571 | B1 | 5/2017 |
| TW | 201008538 | A | 3/2010 |
| TW | M451469 | U | 4/2013 |
| WO | 2016079914 | A1 | 5/2016 |
| WO | 2016157859 | A1 | 10/2016 |
| WO | 2016208175 | A1 | 12/2016 |
| WO | 2017169221 | A1 | 10/2017 |
| WO | 2017169222 | A1 | 10/2017 |
| WO | 2017169223 | A1 | 10/2017 |
| WO | 2017169224 | A1 | 10/2017 |
| WO | 2017169227 | A1 | 10/2017 |

OTHER PUBLICATIONS

Office action dated Jun. 15, 2018 from U.S. Appl. No. 15/928,018, filed Mar. 21, 2018.

Office action dated Sep. 12, 2018 from U.S. Appl. No. 15/890,938, filed Feb. 7, 2018.

Office action dated Sep. 13, 2018 from U.S. Appl. No. 15/928,018, filed Mar. 21, 2018.

Office action dated Sep. 13, 2018 from U.S. Appl. No. 15/891,195, filed Feb. 7, 2018.

* cited by examiner

SELF-CONTAINED TOILET BOWL DISPENSER AND LIGHT

BACKGROUND OF THE INVENTION

1. The Field of the Invention

The invention relates generally to toiletry maintenance and hygiene, wherein the inner surface of a toilet bowl is sprayed with a treatment substance to clean and/or freshen a toilet.

2. The Relevant Technology

Using the commode can be a dreaded process. Often public restrooms are filled with unpleasant odors, smells, and garbage. Some prefer to forgo public restrooms entirely to avoid unsightly smells. The inside of a toilet bowl can become pasted with refuse where smells and bacteria can linger. Public restrooms often use urinal blocks to provide odor relief, but the utility of these blocks is compromised when applied to a general, sitting toilet.

Private toilet use can likewise be an uncomfortable experience, where a user does not want smells permeating throughout a home, or where a user does not want smells to linger for the next occupant. Some manual hand sprays are used to mask unpleasant odors in the toilet bowl, but these sprays only work if the user chooses to spray the fragrance. Additionally, these sprays require users to carry them around in case there is a time of need.

Various dispensers have been conceived. Some dispensers discharge fragrance from a wall in hopes that the fragrance diffuses throughout the room. Other dispensers use the mechanical pressure of flushing the toilet handle to actuate a discharge of the dispenser. Some dispensers use the flow of water through or around the dispenser to discharge material into a toilet bowl.

As discussed, different dispensing models have been produced throughout the years, however, these attempts have failed to provide sufficient value to produce a ubiquitous, commercially-successful toilet dispenser.

BRIEF SUMMARY OF THE INVENTION

It is a main object of the present invention to provide a toilet dispenser and light that can be fitted around a toilet rim, thus providing the user with automatic lighting and dispensing of a treatment substance into a toilet bowl. In at least one disclosed embodiment the invention comprises a body, an arm extending from the body, a nozzle connected to the arm, at least one control circuit within the body, at least three sensing units communicatively coupled with the at least one control circuit, a power source within the body, a replaceable propellant container within the body, at least a first and second pouch within the propellant container, at least one liquid treatment substance within the first and second pouch, a conduit connecting the propellant container and nozzle, and a light located on the arm, wherein the light is communicatively coupled with the at least one control circuit and wherein the light emits visible light into a toilet bowl.

In at least one disclosed embodiment the invention comprises a method of measuring that ambient light intensity near a toilet does not exceed a predetermined intensity threshold, detecting that a user is in an area adjacent to the toilet, activating a light and secondary sensor within a toilet bowl for a predetermined period of time, detecting a user in close proximity to the toilet bowl, and discharging a treatment substance into a toilet bowl.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Various aspects of the novel systems, apparatuses, and methods are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the novel systems, apparatuses, and methods disclosed herein, whether implemented independently of, or combined with, any other aspect of the invention. For example, an apparatus may be implemented or a method may be practiced using any number of the aspects set forth herein. In addition, the scope of the invention is intended to cover such an apparatus or method which is practiced using other structure, functionality, or structure and functionality in addition to or other than the various aspects of the invention set forth herein. It should be understood that any aspect disclosed herein may be embodied by one or more elements of a claim.

Although particular aspects are described herein, many variations and permutations of these aspects fall within the scope of the disclosure. Although some benefits and advantages of the preferred aspects are mentioned, the scope of the disclosure is not intended to be limited to particular benefits, uses, or objectives. Rather, aspects of the disclosure are intended to be broadly applicable to different dispensers, some of which are illustrated by way of example in the figures and in the following description of the preferred aspects. The detailed description and drawings are merely illustrative of the disclosure rather than limiting, the scope of the disclosure being defined by the appended claims and equivalents thereof.

The attached drawings illustrate examples. Elements indicated by reference numbers in the attached drawings correspond to elements indicated by like reference numbers in the following description.

Figure 1:
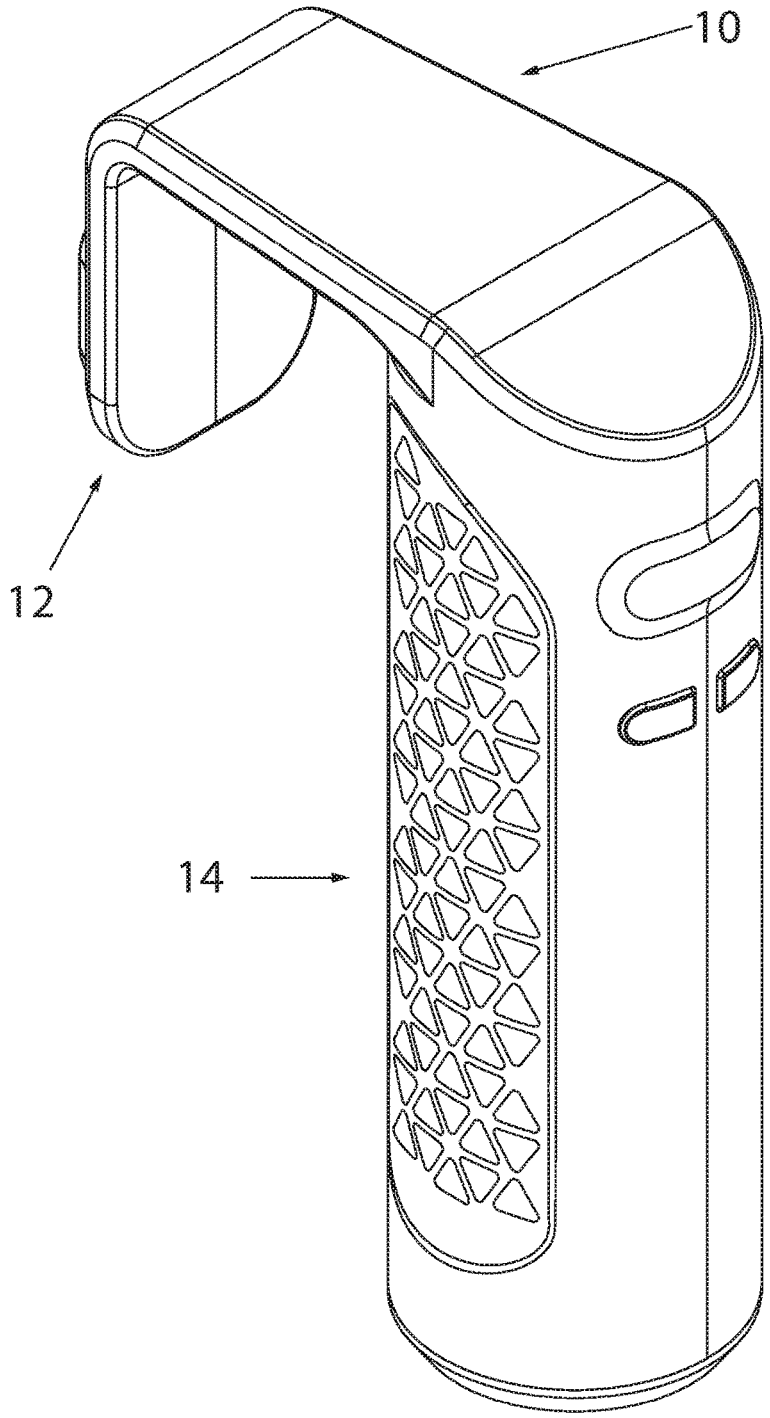
FIG. 1 illustrates an elevational view of the dispenser.

Referring to FIG. 1, connecting portion 10 extends from body 14. Arm 12 extends from connecting portion 10. The connecting portion 10, body 14, and arm 12 are shaped in such a manner as so coincide with the geometry of a toilet.

Figure 2:
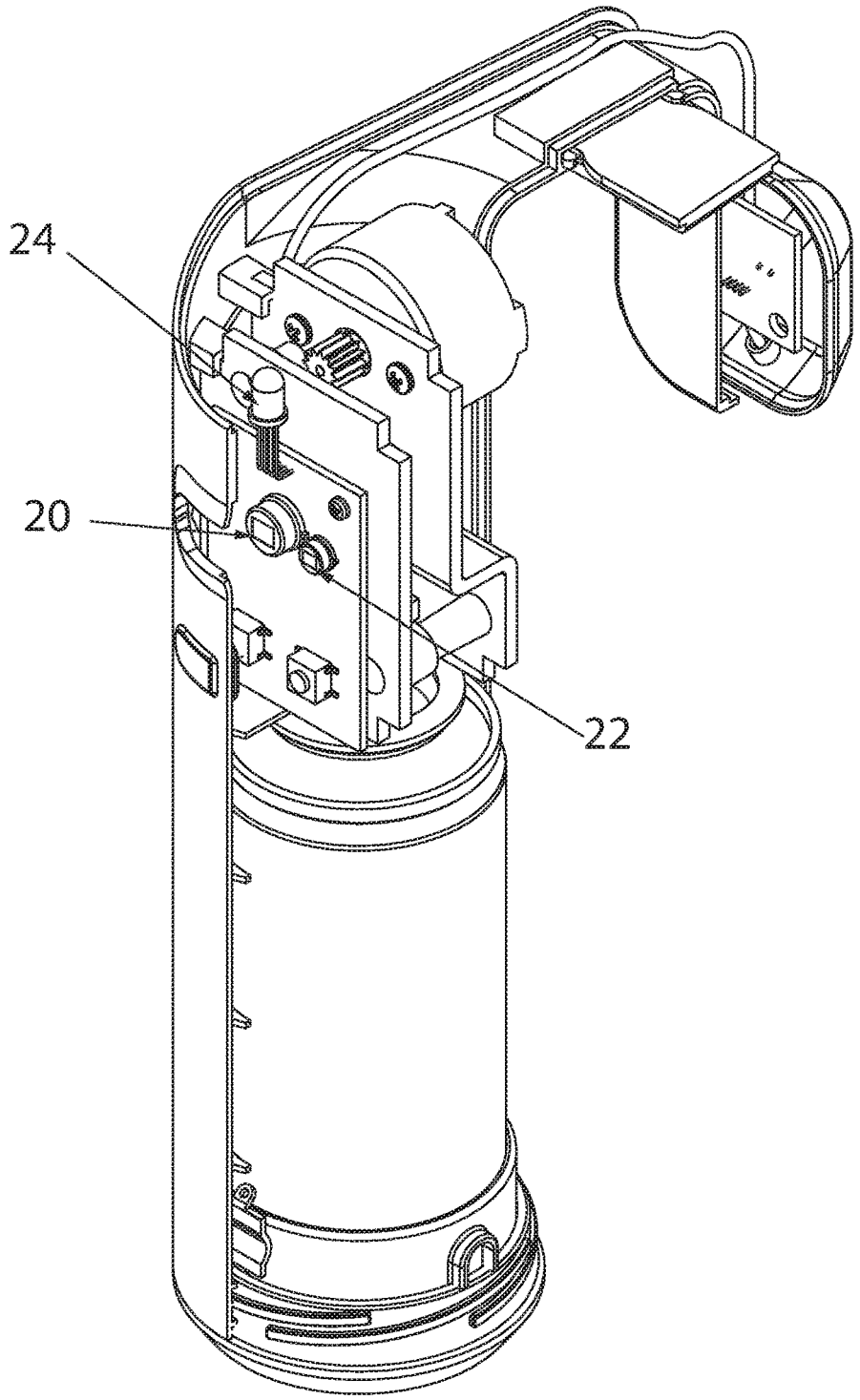
FIG. 2 illustrates a cutaway view of the dispenser featuring the sensors and indicator light on the body of the dispenser.

Referring to FIG. 2, indicator 24 is an indicator light positioned at the top of body 14. When indicator 24 is in use, it shines through a transparent covering on the top of body 14. In at least one embodiment, indicator 24 is a red, green, and yellow light emitting diode (LED), but various other light sources may be used. Indicator 24 signifies, through various blinking patterns and colors, that the propellant container 88 needs to be replaced, that the user has turned off the dispensing function of the dispenser for a period of time, that the user has turned on the dispensing function of the dispenser, or that the user has manually initiated an on-demand spray.

Ambient sensor 22 detects ambient light intensity surrounding the body of the dispenser. Ambient sensor 22 could be any form of photodetector or photosensor. In at least one embodiment ambient sensor 22 is a photodiode, photo transistor, photoresistor, photodiode LED, or quantum dot photodetector. Ambient sensor 22 actuates a signal to at least one control circuit when the ambient light intensity surrounding the body of the dispenser does or does not exceed a predetermined threshold. Preferably the light intensity threshold corresponds to a dimly-lit room. In at least one embodiment the light intensity threshold is about 5 lux. In at least one embodiment the light intensity threshold is at least 5 lux. In at least one embodiment the light intensity threshold is about 10 lux. In at least one embodiment the light intensity threshold is anywhere from 5 to 100 lux. In at least one embodiment the light intensity threshold is anywhere from 100 to 1,000 lux.

Exterior sensor 20 detects occupancy of a user in the field of view on the exterior of body 14. In at least one embodiment it is a passive infrared sensor, however exterior sensor 20 could be any form of an occupancy sensor. Examples of these include an active infrared sensor, ultrasonic sensor, or the like. Exterior sensor 20 communicates with body PCB 84 or arm PCB 110 when occupancy of a user is detected.

Figure 3:
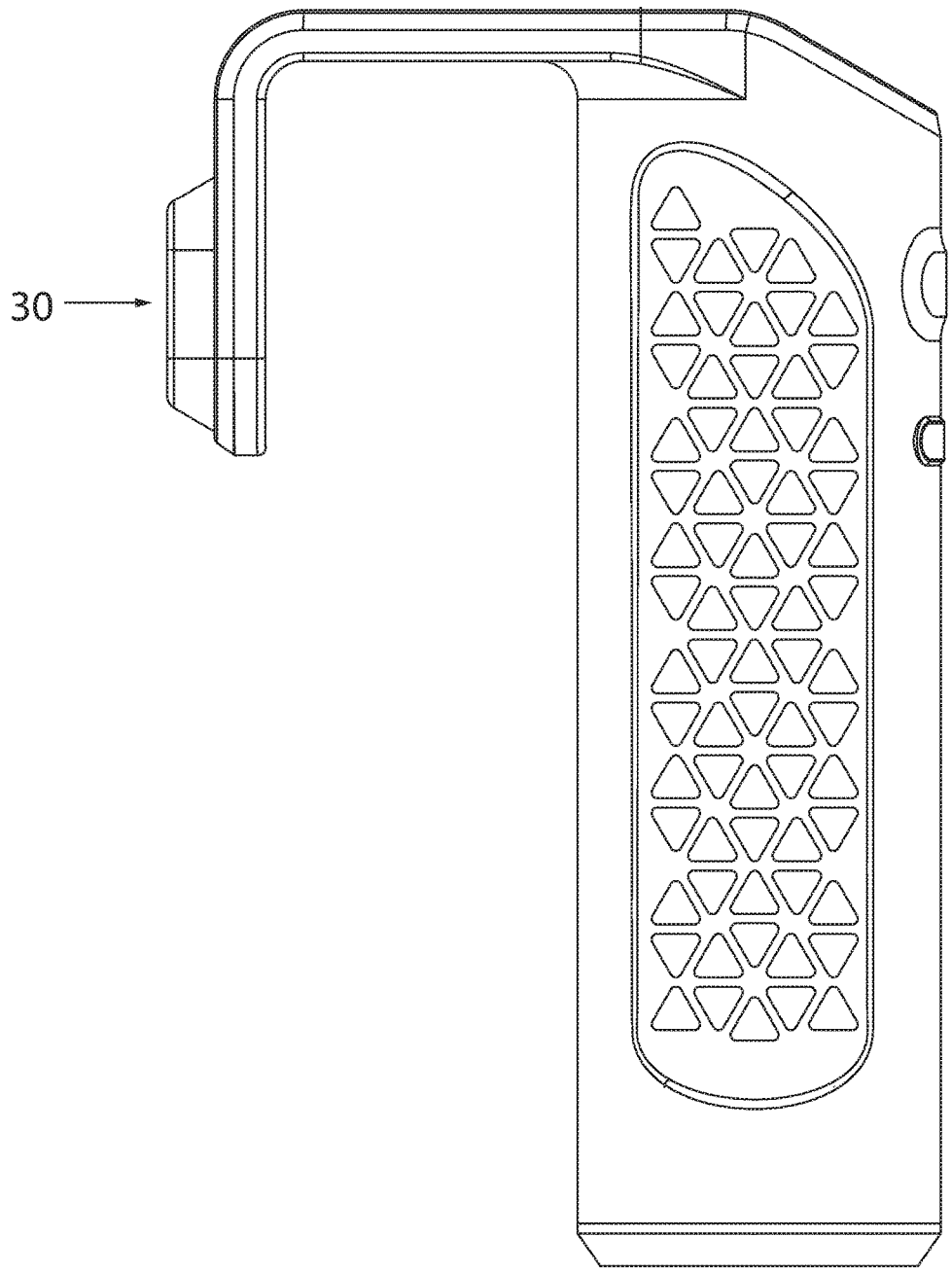
FIG. 3 illustrates a side view of the dispenser.

Referring to FIG. 3, protrusion 30 is located on the lower portion of arm 12. It houses several components that will be discussed hereafter.

Figure 4:
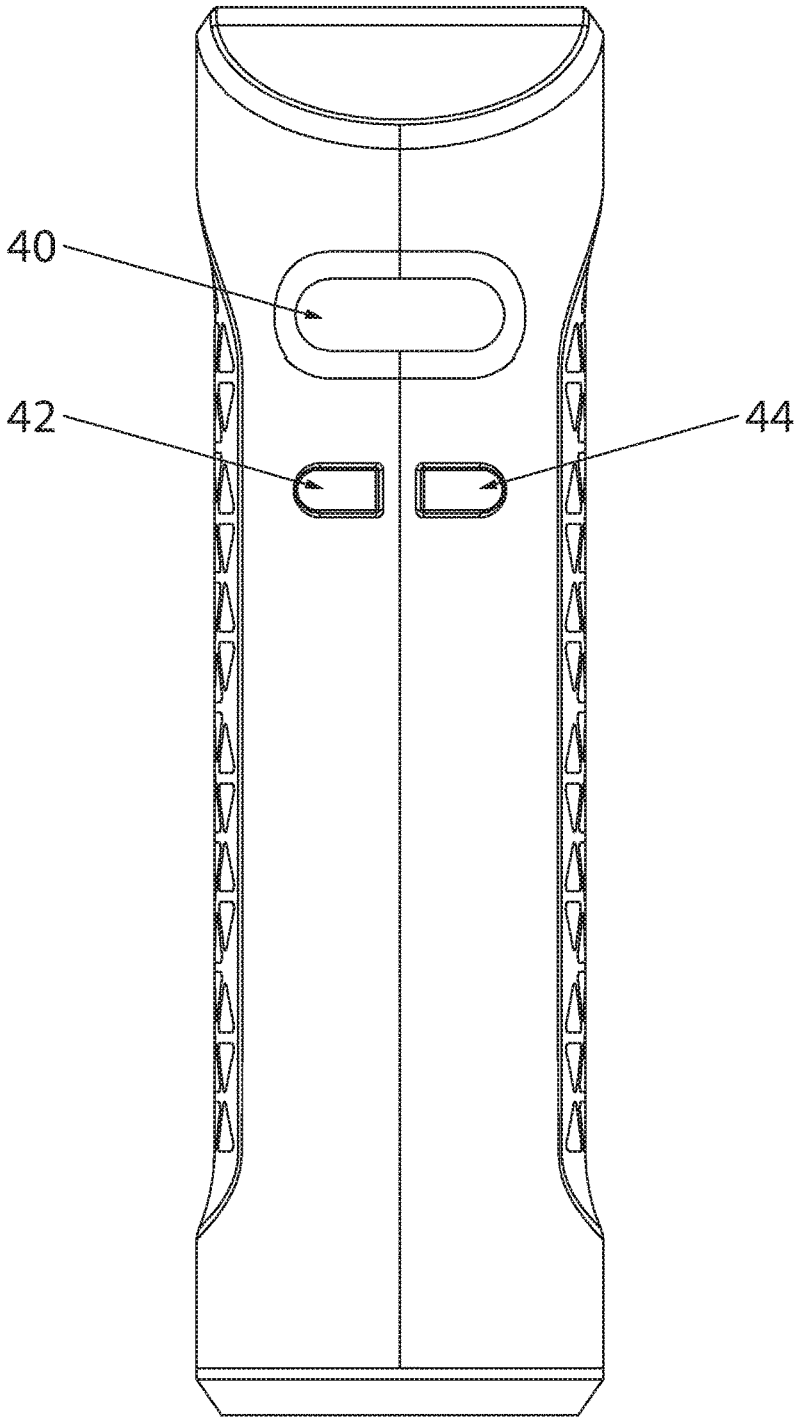
FIG. 4 illustrates a part of the body of the dispenser.

Referring to FIG. 4, cover 40 is a transparent cover on the outside of exterior sensor 20 and ambient sensor 22. Electromagnetic waves pass through cover 40 before being transmitted from or falling on exterior sensor 20 or ambient light sensor 22. Cover 40 could be any transparent material that sufficiently conveys light. In at least one embodiment cover 40 is a translucent material.

Light toggle 44 is located on body 14 and enables a user to manually turn on light 112 for a predetermined period of time, change the color of light 112, turn off light 112 for an extended period of time, turn off light 112 for a shortened period of time, or the like.

Dispensing toggle 42 is located on body 14 and enables a user to immediately discharge a treatment substance into a toilet bowl 132, turn off the discharging function for an extended period of time, turn on the discharging function, turn off the discharging function for a shortened period of time, or the like. Both light toggle 44 and dispensing toggle 42 require a user to manually push the toggle to initiate a response.

Figure 5:
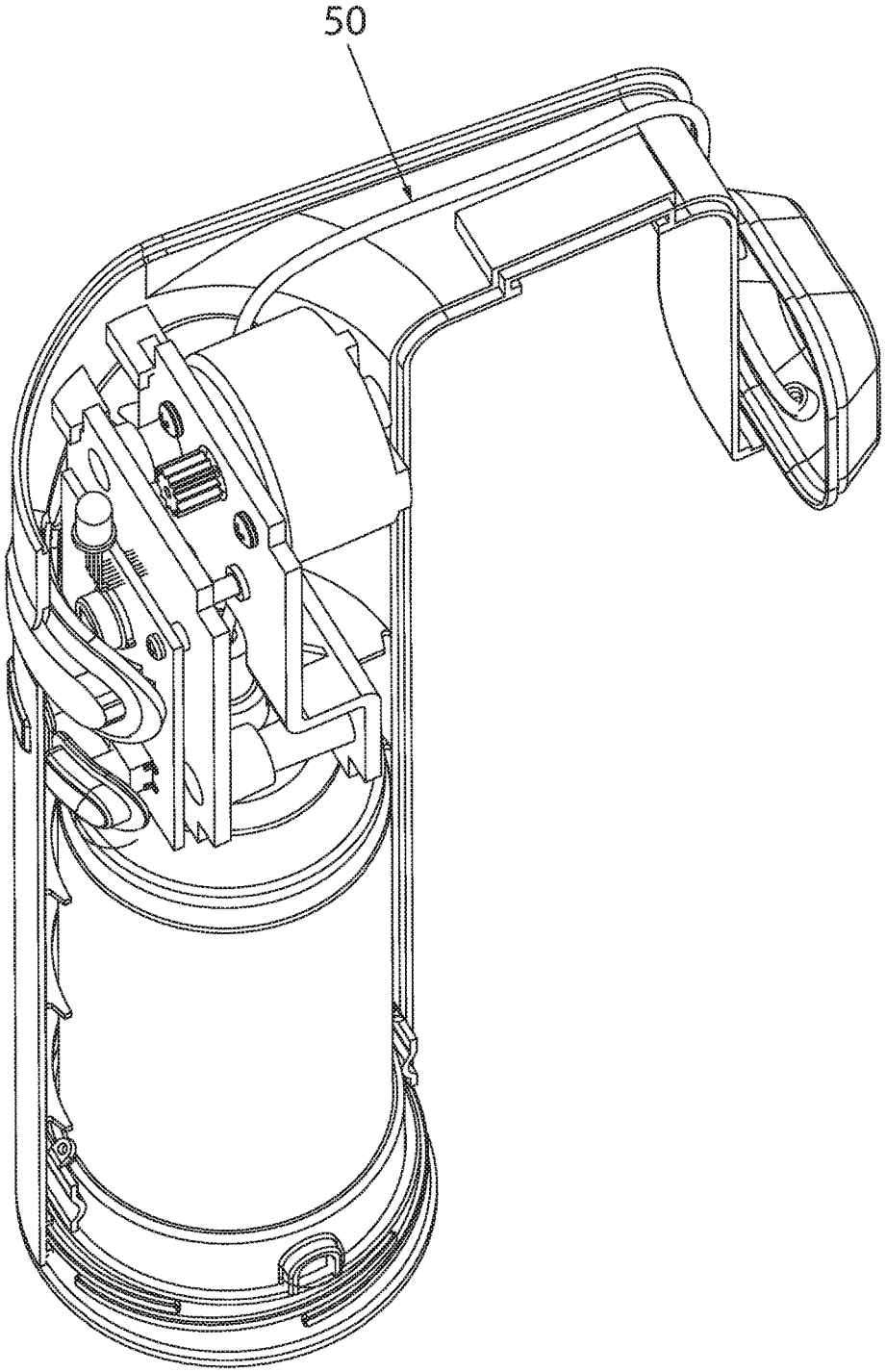
FIG. 5 illustrates a cutaway view of the dispenser featuring a conduit.

Referring to FIG. 5, conduit 50 runs from propellant container 88 to nozzle 100 and enables the passage of treatment substances from propellant container 88 to nozzle 100. Wiring may run along conduit 50.

Figure 6:
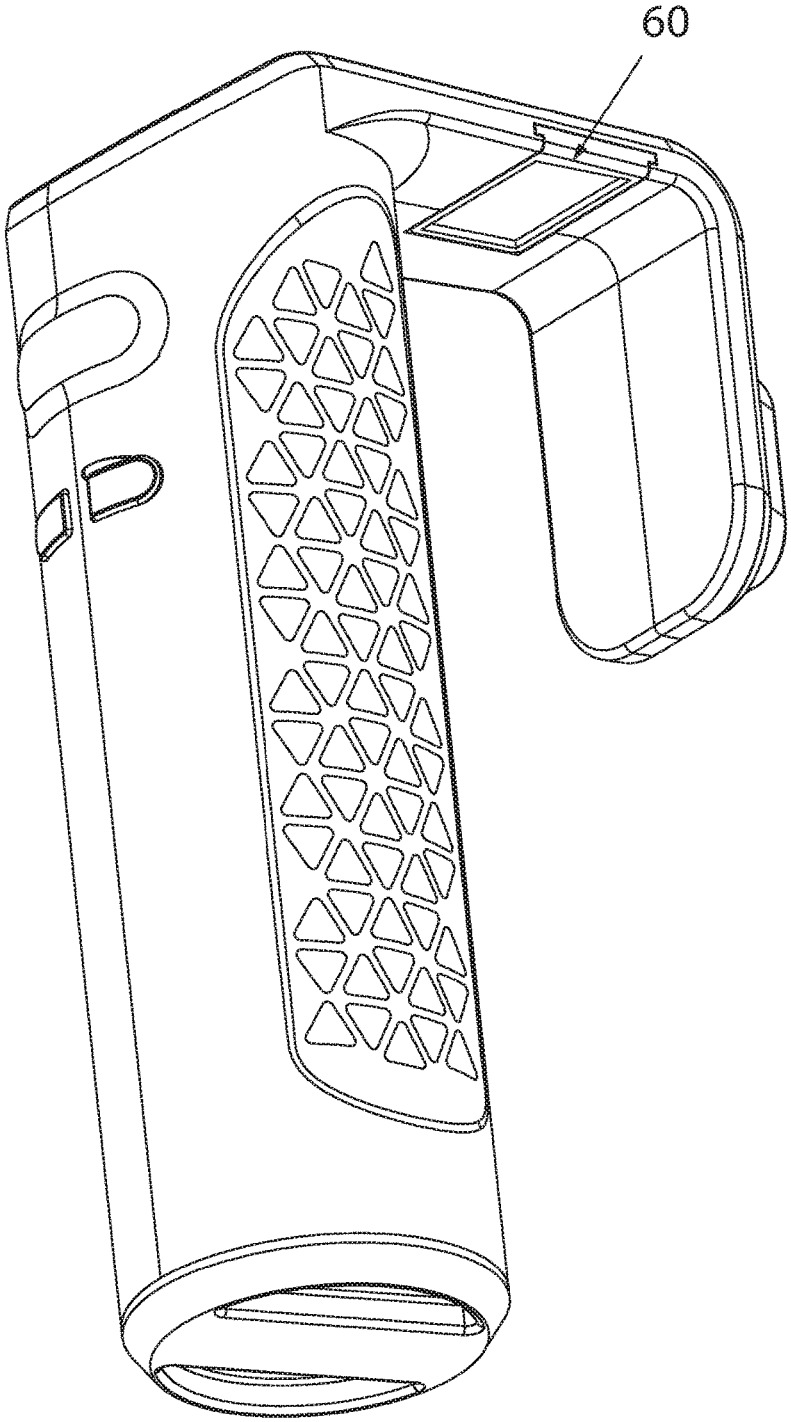
FIG. 6 illustrates an elevational view of the dispenser featuring a mounting clip inserted.

Referring to FIG. 6, mounting clip 60 is configured in size and shape to detachably connect to connecting portion 10. In at least one embodiment, mounting clip 60 attaches to a toilet bowl 132 through adhesives. In at least one embodiment mounting clip 60 attaches to a toilet bowl 132 through suction. In at least one embodiment, mounting clip 60 is replaceable. In at least one embodiment mounting clip 60 emits fragrances.

Figure 7:
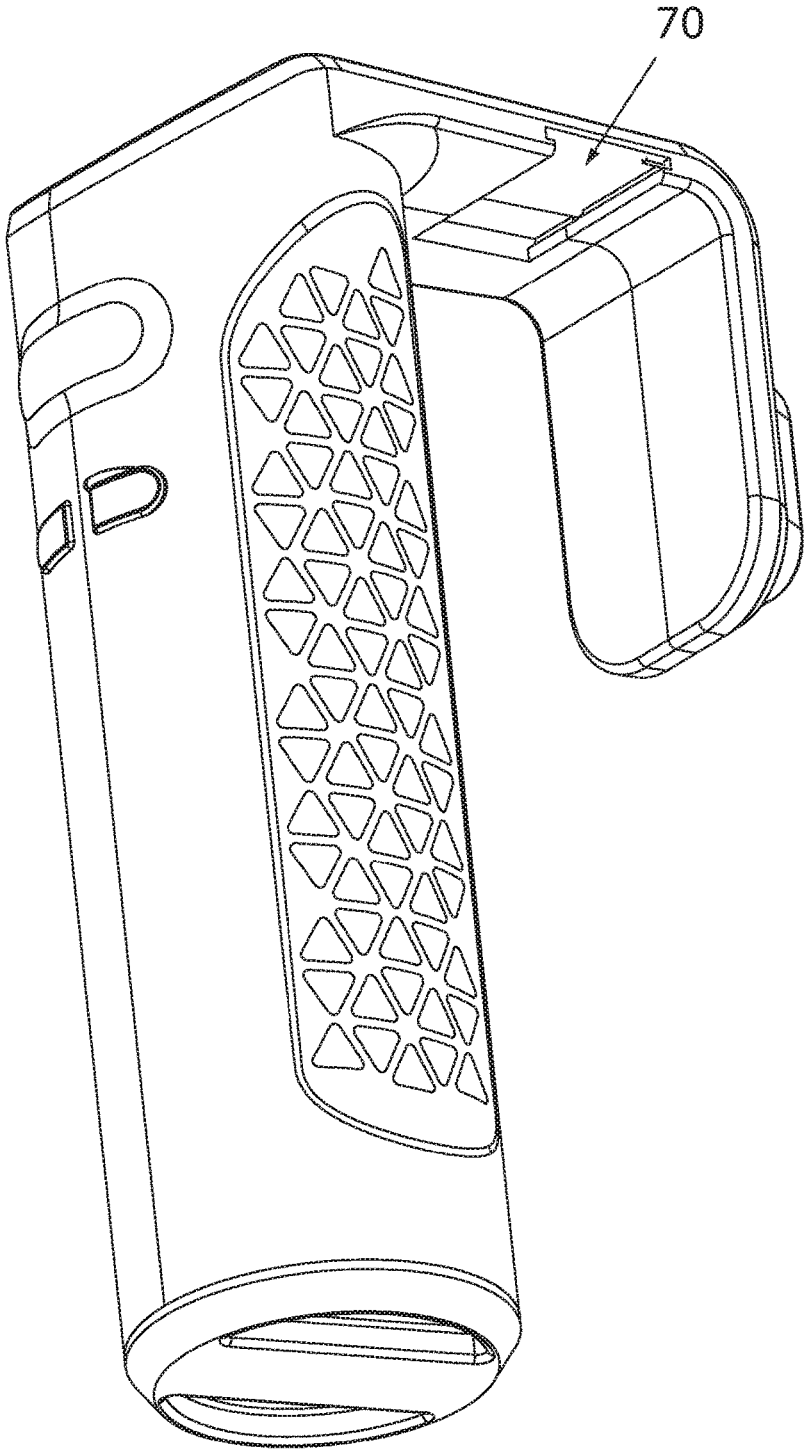
FIG. 7 illustrates an elevational view of the dispenser featuring a groove with the mounting clip removed.

Referring to FIG. 7, mounting clip groove 70 is located on connecting portion 10 and facilitates the attachment of mounting clip 60 to connecting portion 10. In at least one embodiment, mounting clip groove 70 contains a locking portion to secure mounting clip 60 to mounting clip groove 70. In at least one embodiment mounting clip groove 70 contains magnetic strips that correspond to magnetic portions on mounting clip 60, thus securing mounting clip 60 to mounting clip groove 70. In at least one embodiment, mounting clip groove 70 and mounting clip 60 correspondingly fit together in a complementary fashion such as through a sliding dovetail, dado, dovetail, tongue and groove, or the like.

Figure 8:
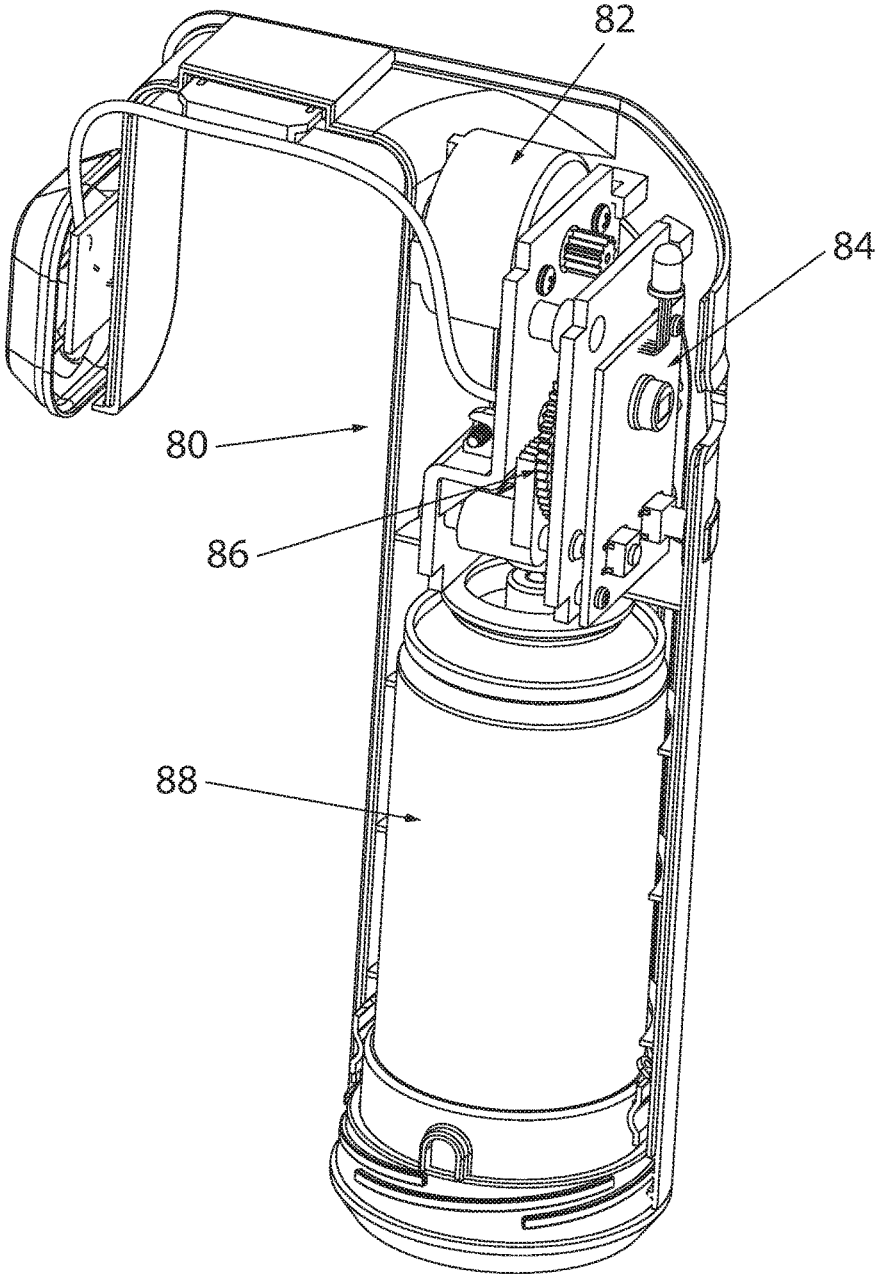
FIG. 8 illustrates a cutaway view of the dispenser featuring many of the internal mechanics.

Referring to FIG. 8, propellant container 88 is housed within body 14. Propellant container 88 is attached to conduit 50. Propellant container 88 may be any form of container that houses liquids and gasses. In at least one embodiment, propellant container 88 is an aerosol container. In at least one embodiment propellant container 88 is pressurized. In at least one embodiment propellant container houses a first pouch 120 and a second pouch 122. In at least one embodiment propellant container 88 is replaceable.

Body 14 also houses internal mechanics 80. The internal mechanics 80 work in harmony to actuate a discharge of propellant container 88. Motor 82 is electrically connected to power source 90. Motor 82 drives internal gears 86 to actuate a discharge. In at least one embodiment, body PCB 84 is a control circuit that, in harmony with arm PCB 110, electrically communicates with ambient sensor 22, exterior sensor 20, motor 82, internal sensor 114 & 116, light 112, light toggle 42, dispensing toggle 44, indicator 24, or the like. In at least one embodiment, the detection of occupancy from exterior sensor 20 prompts body PCB 84 to activate internal sensor 114 & 116 for a shortened period of time. In at least one embodiment internal sensor 114 & 116 are always activated. In at least one embodiment, the detection of occupancy from exterior sensor 20 prompts body PCB 84 to activate light 112 for a shortened period of time. In at least one embodiment, the detection by ambient sensor 22 of light intensity exceeding a predetermined threshold prompts body PCB 84 to prevent the activation of light 112. In at least one embodiment, the detection of occupancy by internal sensor 114 & 116 prompts body PCB 84 to actuate a signal to discharge a treatment substance. In at least one embodiment, the detection of occupancy by exterior sensor 20 prompts body PCB 84 to actuate a signal to discharge a treatment substance. In at least one embodiment, the pressing of dispensing toggle 42 prompts body PCB 84 to immediately actuate a discharge. In at least one embodiment, the prolonged pressing of dispensing toggle 42 prompts body PCB 84 to prevent a discharge for a period of time. In at least one embodiment, the pressing of light toggle 44 prompts body PCB 84 to immediately activate light 112 for a period of time. In at least one embodiment, the prolonged pressing of light toggle 44 prompts body PCB 84 to prevent the activation of light 112 for a period of time. In at least one embodiment, the pressing of light toggle 44 prompts body PCB 84 to change the color of light 112. In at least one embodiment, the detection of an expelled, or a near-expelled, propellant container prompts body PCB 84 to activate indicator 24. In at least one embodiment, the detection of an expelled, or a near-expelled, propellant container prompts body PCB 84 to change the color of indicator 24.

Figure 9:
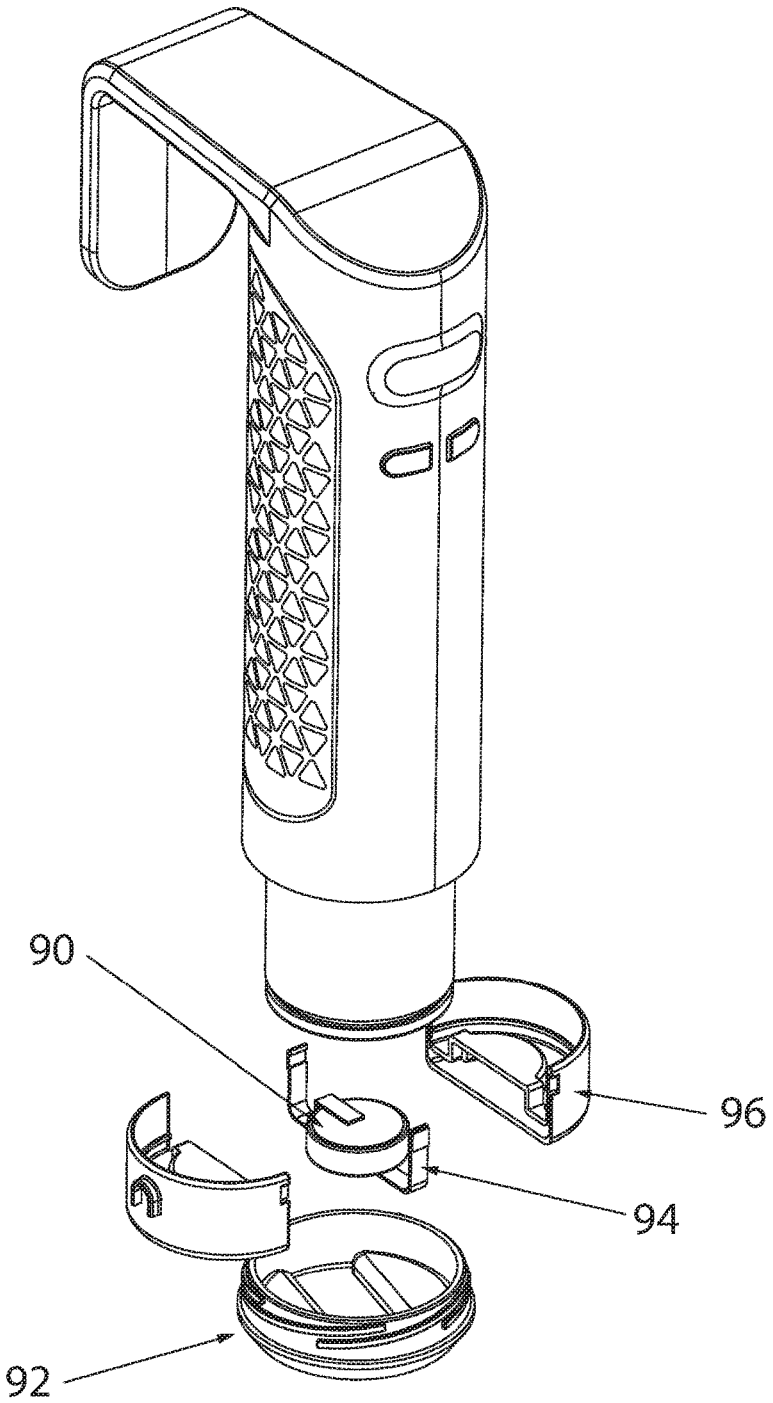
FIG. 9 illustrates an exploded view of removable components of the body of the dispenser.

Referring to FIG. 9, power source 90 provides power for the electronic components of the dispenser. Attachment clips 94 secure power source 90 to propellant container 88. In at least one embodiment, power source 90 and propellant container 88 are attached in such a manner that they are simultaneously replaceable. In at least one embodiment, power source 90 and propellant container 88 are replaceable. In at least one embodiment, power source 90 is optimized so it will be depleted when propellant container 88 is expended. In at least one embodiment, propellant container 88 is optimized to be depleted when power source 90 is expended.

Fastener 96 secures power source 90 and attachment clips 94 in the correct position. In at least one embodiment fastener 96 is detachable. Threaded cap 92 secures the bottom of body 14 and is detachable. Power source 90 may be a battery, a rechargeable battery, a capacitor, or the like.

Figure 10:
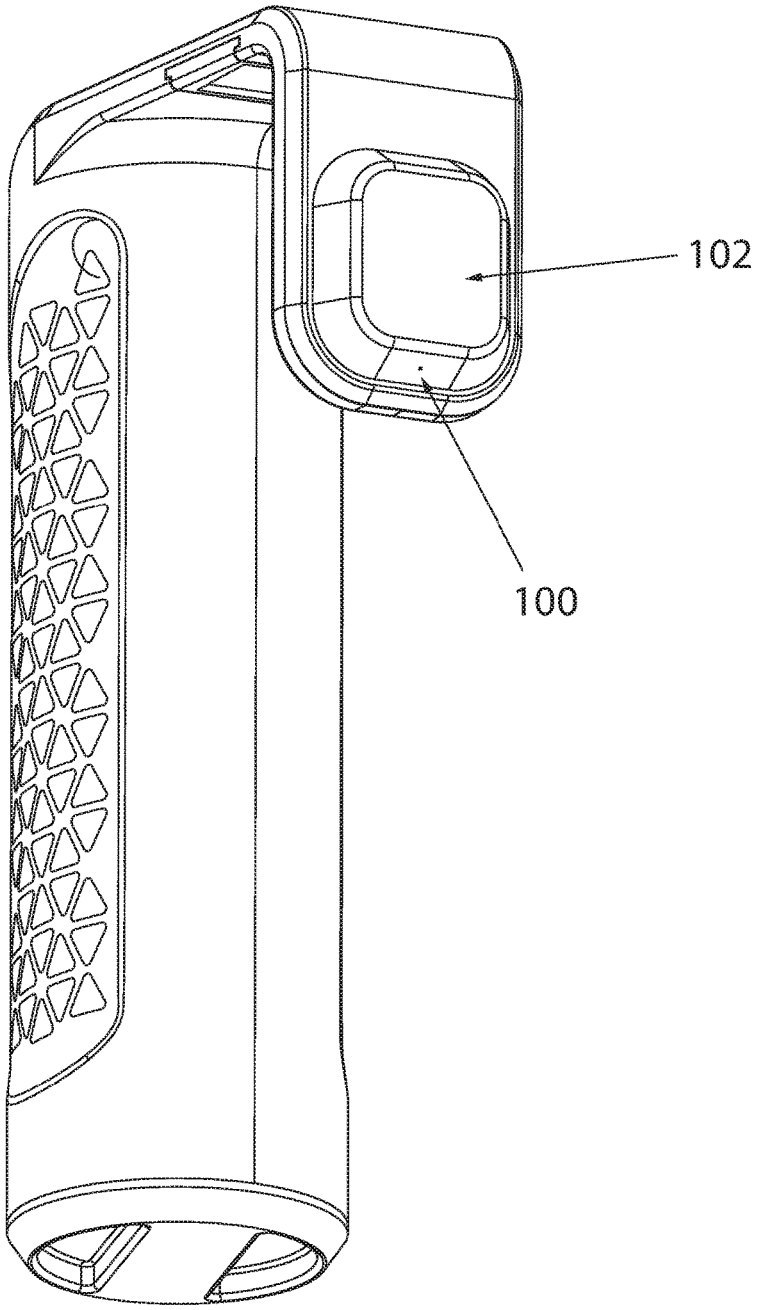
FIG. 10 illustrates an elevational view of the dispenser and light featuring the arm of the dispenser.

Referring to FIG. 10, lens 102 is located on protrusion 30 and acts as a covering for internal sensor 114 & 116 and light 112. In at least one embodiment lens 102 is transparent. In at least one embodiment lens 102 is translucent. In at least one embodiment lens 102 is not shaped to diffract light. In at least one embodiment lens 102 is shaped to diffract light into the toilet bowl 132. In various embodiments, lens 102 is biconvex, plano-convex, positive meniscus, negative meniscus, plano-concave, or biconcave.

Nozzle 100 is the outlet through which a treatment substance is discharged. In at least one embodiment, nozzle 100 sprays a treatment chemical in a diffuse manner so that it covers the liquid reservoir of a toilet bowl 132. In at least one embodiment, nozzle 100 sprays a treatment chemical at a lateral angle into the liquid reservoir of a toilet bowl 132. In at least one embodiment, nozzle 100 sprays a treatment chemical in a cone shape into the liquid reservoir of a toilet bowl 132. In various embodiments, nozzle 100 is a flat-fan, an even flat-fan, a hollow cone, a full cone, a twin-orifice flat-fan, a flood nozzle, or the like. In at least one embodiment, nozzle 100 is angled downwards toward the liquid reservoir of a toilet bowl 132.

Figure 11:
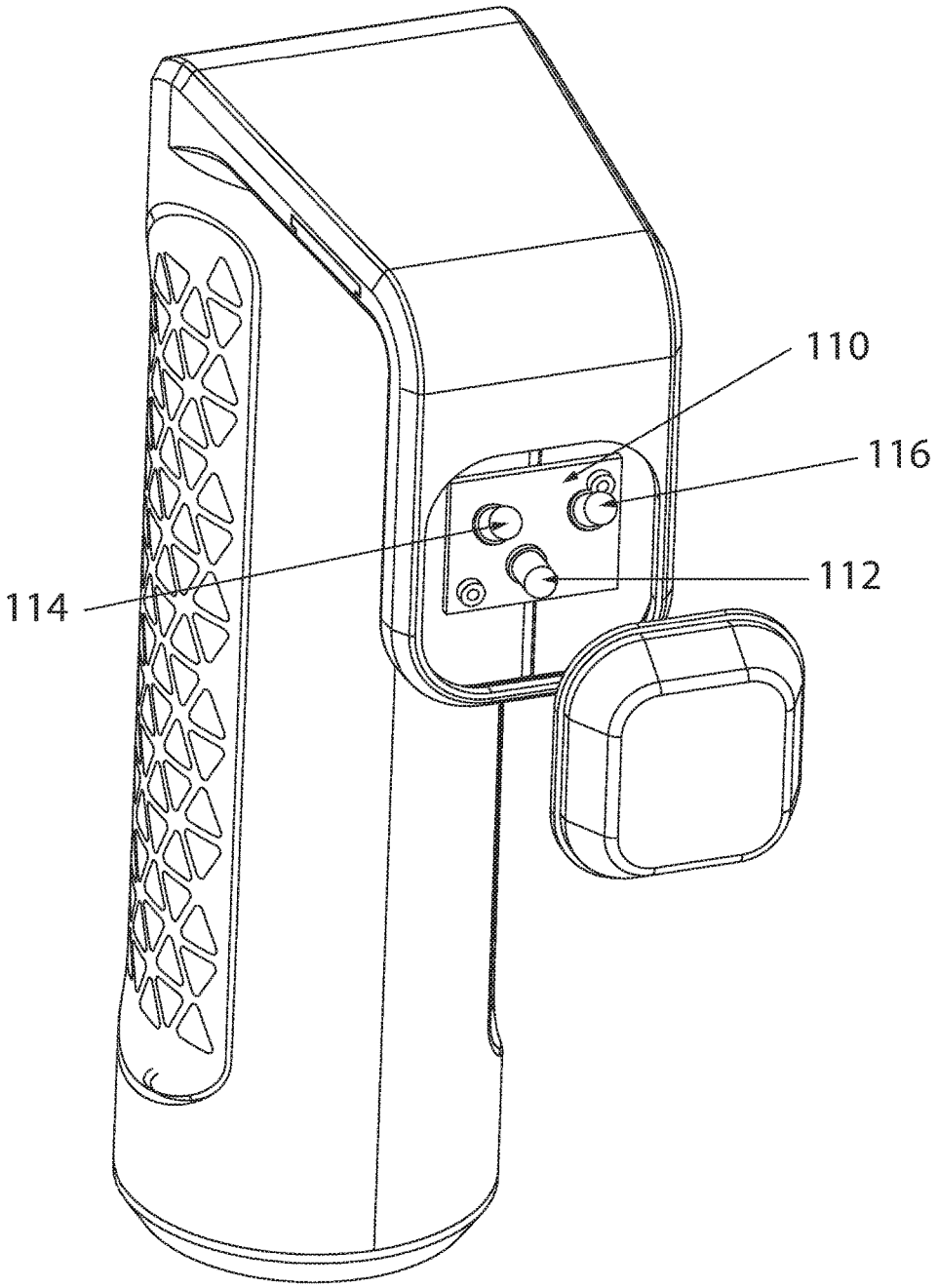
FIG. 11 illustrates an exploded view of the arm of the dispenser.

Referring to FIG. 11, light 112 is located in protrusion 30 and provides light for a toilet bowl. In at least one embodiment, light 112 is a red, green, blue light emitting diode (LED). In various embodiments light 112 is a laser, a fluorescent light, a compact fluorescent light (CFL), incandescent light, halogen light, or the like. In at least one embodiment light 112 is communicatively connected to body PCB 84. In at least one embodiment light 112 is communicatively connected to arm PCB 110. In at least one embodiment light 112 is angled vertically downwards into a toilet bowl 132. In at least one embodiment light 112 is positioned horizontally.

Internal sensor comprises emitter 114 & receiver 116, wherein, in at least one embodiment, emitter 114 is an infrared emitter and receiver 116 is an infrared receiver. In the preferred embodiment, emitter 114 transmits an infrared signal and receiver 116 receives it. In at least one embodiment internal sensor 114 & 116 is an active IR sensor. In at least one embodiment internal sensor 114 & 116 detects an infrared signature. In at least one embodiment internal sensor 114 & 116 is a passive IR sensor. Internal sensor 114 & 116 is angled upwards towards the opening of a toilet bowl 132.

In at least one embodiment, arm PCB 110 is a control circuit that, in harmony with body PCB 84, electrically communicates with ambient sensor 22, exterior sensor 20, motor 82, internal sensor 114 & 116, light 112, light toggle 42, dispensing toggle 44, indicator 24, or the like. In at least one embodiment, the detection of occupancy from exterior sensor 20 prompts arm PCB 110 to activate internal sensor 114 & 116 for a shortened period of time. In at least one embodiment internal sensor 114 & 116 are continuously activated. In at least one embodiment, the detection of occupancy from exterior sensor 20 prompts arm PCB 110 to activate light 112 for a shortened period of time. In at least one embodiment, the detection by ambient sensor 22 of light intensity exceeding a predetermined threshold prompts arm PCB 110 to prevent the activation of light 112. In at least one embodiment, the detection of occupancy by internal sensor 114 & 116 prompts arm PCB 110 to actuate a signal to discharge a treatment substance. In at least one embodiment, the detection of occupancy by internal sensor 114 & 116 prompts arm PCB 110 to actuate a signal to discharge a treatment substance. In at least one embodiment, the pressing of dispensing toggle 42 prompts arm PCB 110 to immediately actuate a discharge. In at least one embodiment, the prolonged pressing of dispensing toggle 42 prompts arm PCB 110 to prevent a discharge for a period of time. In at least one embodiment, the pressing of light toggle 44 prompts arm PCB 110 to immediately activate light 112 for a period of time. In at least one embodiment, the prolonged pressing of light toggle 44 prompts arm PCB 110 to prevent the activation of light 112 for a period of time. In at least one embodiment, the pressing of light toggle 44 prompts arm PCB 110 to change the color of light 112. In at least one embodiment, the detection of an expelled, or a near-expelled, propellant container prompts arm PCB 110 to activate indicator 24. In at least one embodiment, the detection of an expelled, or a near-expelled, propellant container prompts arm PCB 110 to change the color of indicator 24.

Figure 12:
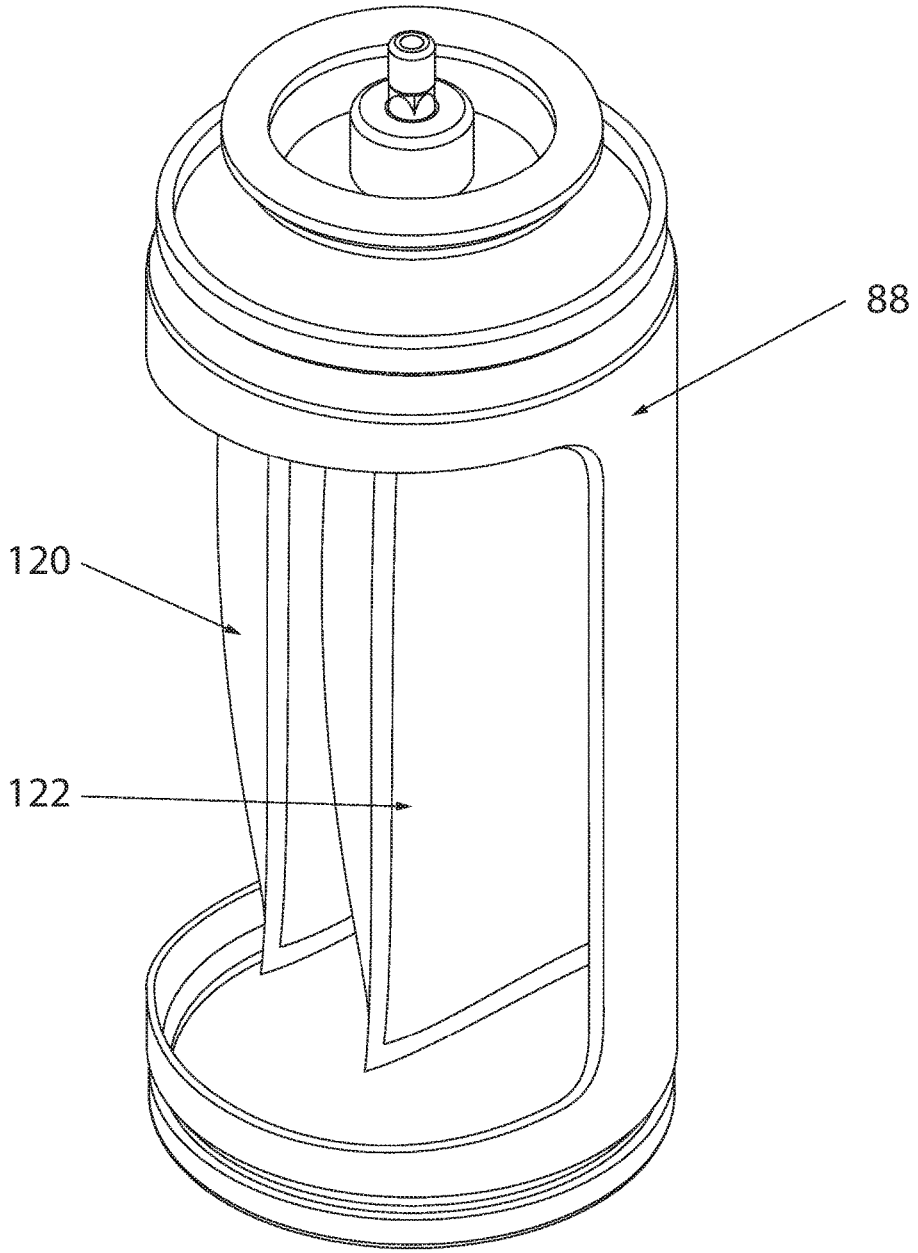
FIG. 12 illustrates a cutaway view of the propellant container.

Referring to FIG. 12, propellant container 88 houses a treatment substance. In at least one embodiment propellant container 88 is removable and replaceable. The treatment substance housed in propellant container 88 may be a fragrance, a cleaning chemical, an oil, a volatile liquid, a liquid less dense than water, a toilet bowl cleaner, an odor-sequestering agent, or the like. In at least one embodiment, propellant container 88 houses first pouch 120 and second pouch 122. In at least one embodiment first pouch 120 houses a water mixture. In at least one embodiment second pouch 122 houses an oil mixture. In at least one embodiment the oil mixture in second pouch 122 is comprised of essential oils. In at least one embodiment the substance in first pouch 120 and the substance in second pouch 122 are combined in the discharge of the dispenser.

Figure 13:
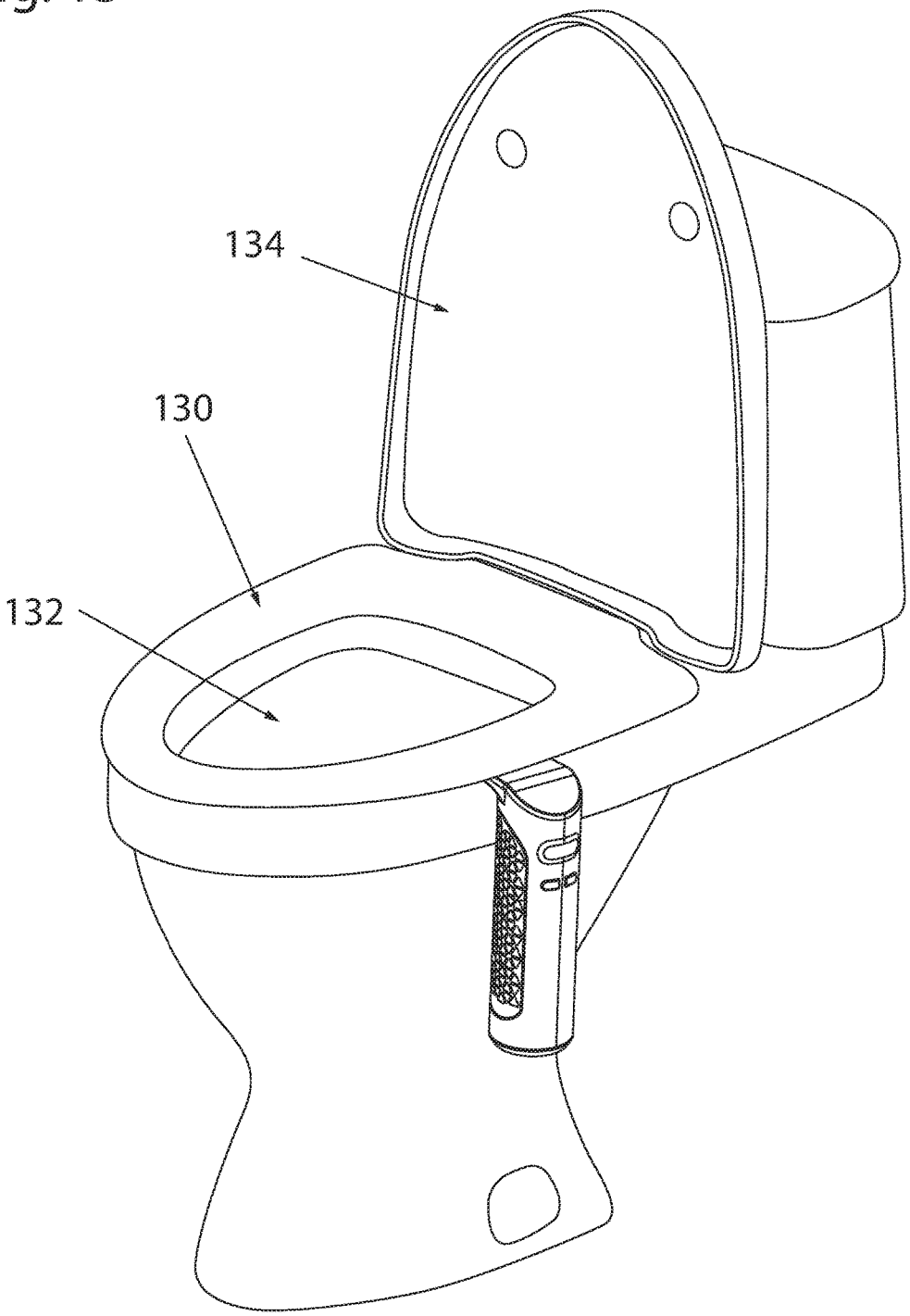
FIG. 13 is a perspective view of the dispenser positioned on the rim of a sitting toilet.

FIG. 13 shows the dispenser and light positioned on a sitting toilet. Toilet bowl 132, toilet rim 130, and toilet lid 134 are shown for reference. The body 14 is positioned on the exterior of toilet bowl 132. Connecting portion 10 is configured in such a way to fit under a toilet seat. In a preferred embodiment, the light projected from light 112 reflects up from toilet bowl 132, thus leading a user to toilet bowl 132 in a dimly-lit environment. In at least one embodiment, the visible light projected from light 112 is brighter than an indicator light or sensor but dim enough to lead a user to a toilet bowl 132 without requiring the user to adjust their eyes in a darkened environment.

Figure 14:
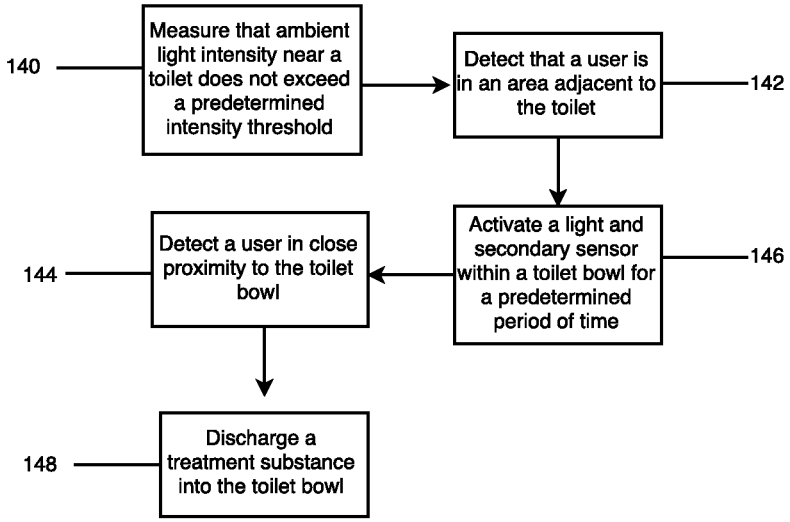
FIG. 14 is a flow diagram for the method of illuminating and treating a toilet bowl.

FIG. 14 shows a method for illuminating and treating a toilet bowl. Step 140 comprises measuring that ambient light intensity near a toilet does not exceed a predetermined intensity threshold. Following step 140 is step 142, in which a user is detected in an area adjacent to the toilet. Following step 142 is step 146, in which a light and secondary sensor are activated within a toilet bowl for a predetermined period of time. Following step 146 is step 144, in which a user is detected in close proximity to a toilet bowl. Following step 144 is step 148, in which a treatment substance is discharged into a toilet bowl. In at least one embodiment, an area adjacent to a toilet is an area within the range of detection of an infrared sensor. In at least one embodiment a predetermined period of time is one minute. In at least one embodiment a predetermined period of time is two to four minutes. In at least one embodiment a predetermined period of time is thirty seconds.

What is claimed is:

1. A self-contained toilet bowl dispenser, comprising:
a body;
an arm extending from the body;
a nozzle connected to the arm the nozzle angled downward toward a liquid reservoir of a toilet bowl, when the arm is positioned on a rim of the toilet bowl;
at least one control circuit within the body;
a first sensor located on the exterior of the body and communicatively coupled with the at least one control circuit, the first sensor being positioned to detect a user in an area adjacent to the toilet bowl in a field of view of the first sensor;
a power source electrically connected to the at least one control circuit;
a removable and replaceable container within the body;
an oil mixture treatment substance within the container;
a conduit connecting the propellant container and the nozzle;
a light located on the arm, wherein the light is communicatively coupled with the at least one control circuit, and wherein the light emits visible light into a toilet bowl;
a second sensor attached to the dispenser and positioned toward an inside of the toilet bowl, wherein the second sensor is activated in response to a signal from the first sensor; and
a motor electrically connected to the power source and communicatively coupled with the at least one control circuit,
wherein, in response to a signal from the second sensor indicating a user is sitting on the toilet and upon receiving a command from the at least one control circuit, the motor facilitates discharge of the oil mixture substance into the liquid reservoir of the toilet bowl.

2. The self-contained toilet bowl dispenser in claim 1, wherein the light comprises an LED light located on the arm or the body, wherein the LED light is communicatively coupled with the at least one control circuit.

3. The self-contained toilet bowl dispenser in claim 2, wherein the LED light is a multicolor LED.

4. The self-contained toilet bowl dispenser in claim 2, wherein the LED light projects light below the rim of the toilet bowl.

5. The self-contained toilet bowl dispenser in claim 2, wherein the LED light is activated for a predetermined period of time upon each detection, by the first sensor, of a user within the field view of the first sensor located on the exterior of the body.

6. The self-contained toilet bowl dispenser in claim 5, further comprising an ambient sensor on the body that measures ambient light surrounding the body.

7. The self-contained toilet bowl dispenser in claim 6, wherein the ambient sensor operates with the at least one control circuit to prevent the activation of the light when the ambient light exceeds a predetermined intensity threshold.

8. The self-contained toilet bowl dispenser in claim 7, wherein the predetermined intensity threshold is 10 lux.

9. The self-contained toilet bowl dispenser in claim 1, wherein the power source and container are connectedly attached to one another such that they are simultaneously replaceable.

10. The self-contained toilet bowl dispenser in claim 9, wherein the power source supplies power to the at least one control circuit at least until the oil mixture in the container is expended.

11. The self-contained toilet bowl dispenser in claim 1, further comprising a mounting clip configured in size and shape to be detachably connected to the arm.

12. The self-contained toilet bowl dispenser in claim 11, wherein the mounting clip attaches to the toilet bowl through an adhesive.

13. A toilet bowl dispenser, comprising:
a body;
an arm extending from the body, wherein the body and arm are attachable to a rim of a toilet;
a nozzle connected to the arm;
at least one control circuit within the body or the arm;
a first sensing unit, externally oriented and attached to the body or the arm and communicatively coupled with the at least one control circuit,
wherein the first sensing unit detects the presence of a user within view of the body;
a second sensing unit attached to the body or the arm and communicatively coupled with the at least one control circuit,
wherein the second sensing unit is activated by the at least one control circuit in response to a signal from the first sensing unit; and
wherein the second sensing unit detects a user occupying the toilet;
a power source within the body;
a replaceable container within the body;
an oil mixture within the container; and
a conduit connecting the container and the nozzle.

14. A self-contained toilet bowl dispenser, comprising:
a body;
an arm extending from the body;

a nozzle connected to the arm the nozzle angled downward toward a liquid reservoir of a toilet bowl, when the arm is positioned on a rim of the toilet bowl;

at least one control circuit within the body;

a first sensor communicatively coupled with the at least one control circuit, the first sensor being positioned to detect a user in an area adjacent to the toilet bowl in a field of view of the first sensor;

a second sensor positioned toward an inside of the toilet bowl, wherein the second sensor is communicatively coupled with the at least one control circuit, and the second sensor is activated by the at least one control circuit in response to a signal from the first sensor;

a power source electrically connected to the at least one control circuit;

a removable and replaceable container within the body;

an oil mixture treatment substance within the container; and a conduit connecting the propellant container and the nozzle.

* * * * *